US007396249B2

(12) United States Patent
Kauffman

(10) Patent No.: US 7,396,249 B2
(45) Date of Patent: Jul. 8, 2008

(54) ELECTRICAL CONNECTOR WITH SNAP-FASTENING COUPLING MECHANISM

(76) Inventor: George M. Kauffman, 14 Abigail Dr., Hudson, MA (US) 01749

( * ) Notice: Subject to any disclaimer, the term of this patent is extended or adjusted under 35 U.S.C. 154(b) by 0 days.

(21) Appl. No.: 11/818,918

(22) Filed: Jun. 15, 2007

(65) Prior Publication Data

US 2008/0003861 A1 Jan. 3, 2008

Related U.S. Application Data

(63) Continuation of application No. 11/358,741, filed on Feb. 21, 2006, now Pat. No. 7,234,956.

(60) Provisional application No. 60/713,862, filed on Sep. 2, 2005.

(51) Int. Cl.
*H01R 13/625* (2006.01)

(52) U.S. Cl. ..... 439/349; 439/322; 439/345

(58) Field of Classification Search ..... 439/345, 439/349, 271, 320, 322, 282
See application file for complete search history.

(56) References Cited

U.S. PATENT DOCUMENTS 2,892,991 A 6/1959 Beebee et al.
3,124,404 A 3/1964 Chesnov
3,739,076 A 6/1973 Schwartz
4,176,899 A 12/1979 Betts
5,620,339 A 4/1997 Gray et al.
5,637,010 A 6/1997 Jost et al.
5,785,545 A 7/1998 Holt
6,332,815 B1 12/2001 Bruce
6,464,527 B2 10/2002 Volpe et al.
6,529,357 B1 3/2003 Landinger
6,645,011 B2 11/2003 Schneider et al.
6,709,289 B2 3/2004 Huber et al.
6,835,095 B2 12/2004 Chen

*Primary Examiner*—Michael C Zarroli
(74) *Attorney, Agent, or Firm*—Kriegsman & Kriegsman

(57) ABSTRACT

An electrical connector includes an inner conductor, an annular insulator which surrounds the inner conductor and an outer conductor which surrounds the annular insulator. The electrical connector is provided with both a threaded coupling mechanism and a snap-fastening coupling mechanism. In one embodiment, the threaded coupling mechanism is in the form of an outwardly projecting spiral threading which protrudes out from the mating end of the outer conductor. In the same embodiment, the snap-fastening coupling mechanism is in the form of an annular groove which is formed in the central body of the outer conductor, the annular groove being sized and shaped to receive a resilient, C-shaped snap ring from a mating electrical connector. In this manner, it is to be understood that the electrical connector is capable of being mechanically and electrically coupled to various types of mating electrical connectors using either threaded coupling means or snap-fastening coupling means.

4 Claims, 8 Drawing Sheets

ELECTRICAL CONNECTOR WITH SNAP-FASTENING COUPLING MECHANISM

CROSS-REFERENCE TO RELATED APPLICATIONS

The present application is a continuation of U.S. patent application Ser. No. 11/358,741, filed Feb. 21, 2006, now U.S. Pat. No. 7,234,956 which in turn claims the benefit under 35 U.S.C. 119(e) of U.S. Provisional Patent Application Ser. No. 60/713,862, filed Sep. 2, 2005, the disclosures of both being incorporated herein by reference.

BACKGROUND OF THE INVENTION

The present invention relates generally to electrical connectors and more particularly to electrical connectors that are provided with either threaded or snap-fastening coupling means.

Electrical connectors are well known in the art and are commonly used to electrically connect separate conductive elements in order to complete an electrical circuit.

One type of electrical connector which is well known in the art is the coaxial electrical connector. A coaxial electrical connector is commonly used to transmit high frequency communication signals (e.g., electromagnetic signals over 10 MHz) between a pair of electric devices, wherein examples of electric devices include, but are not limited to, coaxial cables, coaxial switches and signal generating or processing devices. In this capacity, it is to be understood that coaxial electrical connectors are commonly used to transmit and receive signals in various types of conventional communications applications (e.g., audio and video broadcast, cellular phone transmission, global system for mobile (GSM) communications, etc.).

A coaxial electrical connector typically comprises an inner signal conductor (commonly referred to simply as the inner conductor) which serves to transmit the desired communication signal. The inner signal conductor is separated from an outer conductor by an insulating material, or dielectric material, the outer conductor serving as (i) the return path, or ground, for the communication signal and (ii) a shield to prevent degradation of the signal carried by the inner conductor. As can be appreciated, this type of electrical connector is commonly referred to as coaxial because the inner and outer conductors share a common longitudinal axis.

A coaxial electrical connector of the type as described above is also typically provided with a coupling mechanism which serves to securely retain said connector in both electrical and mechanical connection with a corresponding (i.e., mating) electrical connector. Preferably, coaxial electrical connectors are provided with a releasable coupling mechanism in order to allow for the replacement, repair and/or reconfiguration of electrical devices within a particular communication system.

One well-known means for securing together a mated pair of coaxial electrical connectors is through the use of complementary threaded coupling mechanisms (also commonly referred to as screw-type coupling mechanisms in the art). Specifically, in one common version of this coupling means, the male end of a first electrical coaxial connector (i.e., the end of the electrical connector in which the inner conductor is of the male variety) is provided with a independently rotatable coupling nut that includes a spiral recess formed in its inner surface. In addition, the female end of a second electrical coaxial connector (i.e., the end of the electrical connector in which the inner conductor is of the female variety) is provided with an outwardly projecting, spiral threading on the outer surface of its outer conductor. In order to couple together the first and second coaxial connectors, the threading on the female end of the second conductor is aligned within the spiral recess formed in male end of the first conductor. Disposed as such, the coupling nut of the first electrical connector is then rotated in a first direction relative to its longitudinal axis such that its male inner conductor is drawn into electrical contact within the female inner conductor for the second electrical connector, thereby establishing an electrical path therebetween. As can be appreciated, the threaded engagement established between the pair of electrical coaxial connectors serves to securely retain said pair in electrical and mechanical connection with one another. However, if desired, the mated pair of electrical coaxial connectors can be electrically and mechanically disconnected from one another simply by rotating the coupling nut of the first electrical connector in the opposite direction relative to its longitudinal axis until such time that said pair can be mechanically separated.

An example of a mated pair of electrical connectors which can be coupled together using threaded coupling means is shown in U.S. Pat. No. 6,529,357 to J. Landinger et al., which is incorporated herein by reference.

It has been found that the use threaded coupling means to secure together a pair of electrical coaxial connectors is desirable with respect to the quality of the electrical connection established therebetween. Most notably, this means of coupling together a mated pair of coaxial connectors provides a relatively strong and durable level of connection, thereby rendering it particularly suitable for certain applications, such as a high vibration environment and/or an environment which requires minimal accessibility (i.e., a relatively permanent connection).

Although well-known and widely used in the art, the use of threaded coupling means to secure together a mated pair of electrical coaxial connectors suffers from a few notable drawbacks.

As a first drawback, the process of axially rotating one electrical connector relative to another has been found to be substantially cumbersome, time-consuming and highly dexterous in nature, which is highly undesirable.

As a second drawback, the process of axially rotating one electrical connector relative to another often requires a separate tool (i.e., for tightening purposes) which may or may not be readily available to the user, which is highly undesirable.

As a third drawback, the process of axially rotating one electrical connector relative to another necessitates a considerable amount of rotational clearance immediately surrounding the mated pair of connectors (e.g., clearance in the order of the length of a tightening tool used therewith), which is highly undesirable.

Accordingly, another well-known means for securing together a mated pair of coaxial electrical connectors is through the use of snap-fastening coupling means (also commonly referred to as quick-connect, snap, snap-on or push-on coupling means in the art). As defined herein, snap-fastening coupling means relates to the use of any complementary pair of coupling mechanisms which can be secured together by drawing said connectors together using an axial, or linear, force (i.e., with limited twisting, turning and/or screwing). Typically, the use of snap-fastening coupling means to secure together a mated pair of connectors requires a first connector to be linearly displaced relative to a second connector, with a portion of the first connector telescopingly mounting over a portion of the second connector. As can be appreciated, as the first connector is telescopingly slid over the second connector with a suitable force, a latching device (e.g., a pivotable pawl, clip, ring, ball or the like) provided on the inner surface of the first connector releasably snaps into engagement within a detent (e.g., a notch or groove) formed in the outer surface of the second connector. With the latching device engaged within the detent, the pair of connectors are retained in electrical and mechanical connection with one another. If desired, electrical and mechanical disconnection of the pair of connectors can be achieved through the application of a suitable linear separation force.

Examples of mated pairs of electrical connectors which can be coupled together using snap-fastening coupling means include U.S. Pat. No. 6,709,289 to C. W. Huber et al., U.S. Pat. No. 6,645,011 to M. Schneider and U.S. Pat. No. 5,785,545 to T. L. Holt, all of said patents being incorporated herein by reference.

As can be appreciated, the use of snap-fastening coupling means to secure together a mated pair of electrical connectors allows for simple, easy and rapid installation with limited (or even no) rotational motion, thereby minimizing the clearance requirement necessitated by threaded connection means. In this capacity, it is to be understood that use of snap-fastening coupling means to secure together a pair of electrical connectors is most appropriate in environments which are relatively confined and/or in conjunction with systems which require frequent component repair, replacement and/or upgrading.

However, it has been found that the use of snap-fastening coupling means to secure together a mated pair of electrical connectors introduces a few notable drawbacks.

As a first drawback, electrical connectors which are provided with snap-fastening coupling means are often mechanically complex in their design, thereby increasing manufacturing costs, which is highly undesirable.

As a second drawback, electrical connectors which rely on snap-fastening coupling means provide a lesser degree of connective strength than electrical connectors that rely on threaded coupling means.

As a result, it has been recognized that the use of snap-fastening coupling means to secure together a mated pair of electrical connectors is desirable in certain applications (e.g., in confined, dark environments or in the event of an emergency) and that the use of threaded-coupling means to secure together a mated pair of electrical connectors is desirable in other applications (e.g., when a more rugged, permanent connection is required).

Accordingly, it is well-known in the art for separate adapters to be constructed which enable an electrical connector with threaded coupling means to be converted into an electrical connector with snap-fastening coupling means. In this manner, the particular coupling mechanism to be utilized with respect to an electrical connector can be selected based on the particular application with which it is to be used, which is highly desirable.

Examples of adapters which allow an electrical connector with threaded coupling means to be converted into an electrical connector with snap-fastening coupling means include U.S. Pat. No. 6,464,527 to F. Volpe et al., and U.S. Pat. No. 6,332,815 to B. B. Bruce, both of said references being incorporated herein by reference.

Although well-known in the art, the use of adapters of the type described above suffer from a couple notable shortcomings.

As a first shortcoming, adapters of the type described above are constructed separately from the mated pair of electrical connectors. Accordingly, if such an adapter is not readily available to the user, connection between electrical connectors through the use of snap-fastening means can not be readily made, which is highly undesirable.

As a second shortcoming, adapters of the type described above are often mechanically complex in design, thereby increasing manufacturing costs, which is highly undesirable.

SUMMARY OF THE INVENTION

It is an object of the present invention to provide a new and improved electrical connector.

It is another object of the present invention to provide a new and improved electrical connector that is designed for electrical and mechanical engagement with a mating electrical connector.

It is yet another object of the present invention to provide an electrical connector as described above which can be coupled to its mated electrical connector using a relatively strong and durable level of engagement.

It is still another object of the present invention to provide an electrical connector as described above which can be coupled to its mated electrical connector using a minimal coupling force and with a limited amount of rotational clearance.

It is yet still another object of the present invention to provide an electrical connector as described above which is relatively inexpensive to manufacture.

Accordingly, there is provided a first electrical connector adapted to be electrically and mechanically connected to a second electrical connector, the second electrical connector comprising a threaded coupling mechanism and a snap-fastening coupling mechanism, said first electrical connector comprising (a) an inner conductor, (b) an insulator surrounding the inner conductor, (c) a conductive collar surrounding the insulator, (d) an outer body surrounding the conductive collar; the outer body having an inner surface and an outer surface, the inner surface of the outer body being shaped to define a groove, and (e) a snap-fastening coupling mechanism retained within the groove in the outer body, the snap-fastening coupling mechanism being adapted to engage the snap-fastening coupling mechanism for the second electrical connector to retain the first and second electrical connectors in electrical and mechanical connection with one another, (f) wherein the conductive collar and the outer body together define an annular gap which is sized and shaped to receive the threaded coupling mechanism for the second electrical connector when the first and second electrical connectors are electrically and mechanically connected together.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration particular embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate particular embodiments of the invention and, together with the description, serve to explain the principles of the invention. In the drawings wherein like reference numerals represent like parts.

DETAILED DESCRIPTION OF A PREFERRED EMBODIMENT

Figure 1:
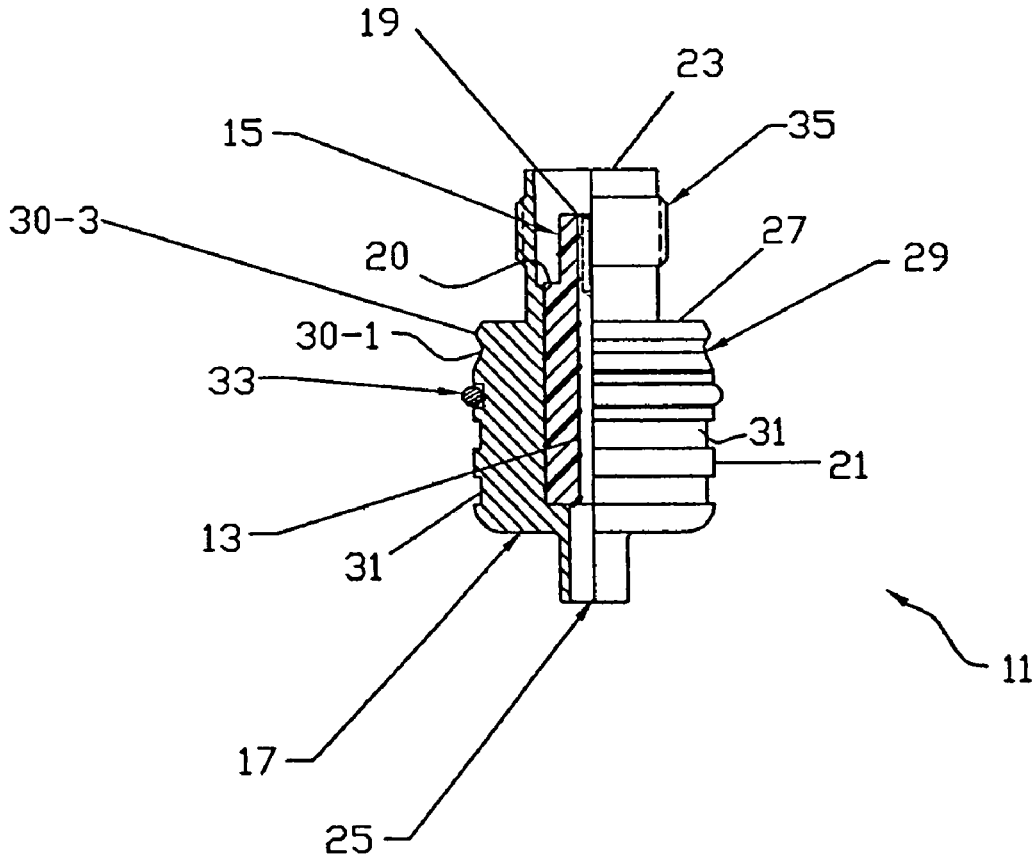
FIG. 1 is a front plan view in partial axial section of a first embodiment of an electrical connector constructed according to the teachings of the present invention.
Figure 4A:
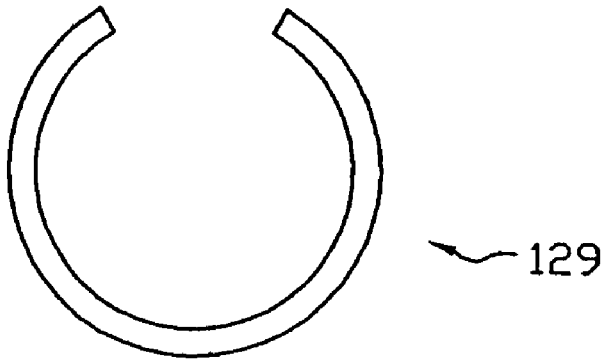
FIGS. 4(*a*) and (*b*) are top plan and side views, respectively, of the snap ring shown in FIG. 3.
Figure 4B:
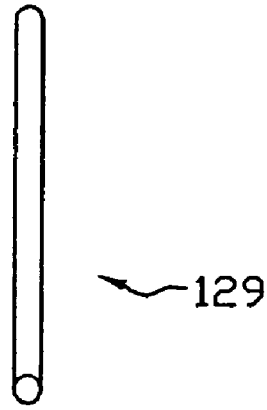

Referring now to FIG. 1, there is shown a first embodiment of an electrical connector that is constructed according to the teachings of the present invention, said electrical connector being identified generally by reference numeral 11. As will be described in detail below, electrical connector 11 is provided with both threaded and snap-fastening coupling mechanisms.

Electrical connector 11 is represented herein as being in the form of a coaxial electrical connector. However, it should be noted that electrical connector 11 is not limited to being the form of a coaxial electrical connector. Rather, it is to be understood that the novel aspects of coaxial electrical connector 11 could be implemented into alternative forms of electrical connectors without departing from the spirit of the present invention.

Electrical connector 11 comprises an inner conductor 13, an annular insulator 15 which surrounds inner conductor 13, and an outer conductor 17 which surrounds annular insulator 15. As can be seen, inner conductor 13 and outer conductor 17 share a common longitudinal axis and are spaced adequately apart from one another by insulator 15.

Inner conductor 13 is represented herein as being in the form of an elongated conductive pin which is responsible for the transmission of communication signals through connector 11. Inner conductor 13 is provided with a female socket, or receptacle, 19 at one of its ends, socket 19 serving as a means for electrically coupling connector 11 with a mating electrical connector, as will be described further in detail below.

Insulator 15 is generally annular in shape and surrounds inner conductor 13. As can be appreciated, insulator 15 serves to both mechanically support inner conductor 13 and electrically insulate inner conductor 15 from outer conductor 17, insulator 15 preferably being constructed of any conventional insulated material, such as PolyTetraFluoroEthylene (PTFE).

It should be noted that the free end of insulator 15 (i.e., the ID portion of female connector 11) has a reduced diameter. As such, a step 20 is defined between insulator 15 and outer conductor 17, the function of step 20 to become apparent below.

Outer conductor 17 is represented herein as being in the form of an elongated, annular conductive member which is acts as (i) the return path, or ground, for the communication signal transmitted by inner conductor 13 and (ii) a shield for preventing degradation of the communication signal transmitted by inner conductor 13. As will be described in detail below, outer conductor 17 is provided with two independent means retaining connector 11 in electrical and mechanical connection with a mating electrical connector, this feature serving as the principal novel aspect of the present invention.

Outer conductor 17 includes an annular central body 21, an annular mating end 23 formed at the first end of central body 21 and an annular cable attachment 25 formed at the second end of central body 21. It should be noted that the outer diameter of central body 21 is substantially greater than the outer diameter of mating end 23 and, as a result, a flat shelf 27 is created at the junction thereof.

The outer surface of central body 21 is provided with a snap-fastening coupling mechanism 29 proximate shelf 27. As will be described in greater detail below, snap-fastening coupling mechanism 29 enables electrical connector 11 to be retained in electrical and mechanical connection with a mating electrical connector using snap-fastening coupling means, which is a principal object of the present invention.

Figure 2:
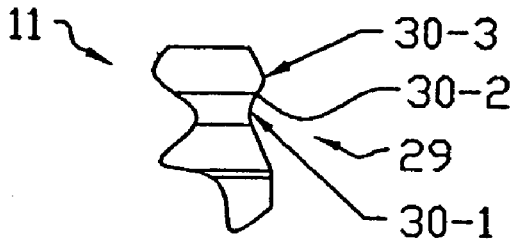
FIG. 2 is an enlarged, fragmentary front plan view of the electrical connector shown in FIG. 1.

As seen most clearly in FIG. 2, snap-fastening coupling mechanism 29 is represented herein as being in the form of an annular, laterally extending, engagement groove 30-1 that is immediately defined along its uppermost periphery by a sloped, or angular, surface 30-2 which is, in turn, bound by an outwardly extending ridge 30-3. However, it should be noted that snap-fastening coupling mechanism 29 is not limited to being in the form of an engagement groove of the type as described above. Rather, it is to be understood that snap-fastening coupling mechanism 29 represents any well-known snap-fastening coupling mechanism (e.g., a socket, notch, detent, ring, pivotable pawl, etc.) which can snap into engagement with a complementary component without departing from the spirit of the present invention.

The outer surface of central body 21 is additionally provided with three, spaced apart, lateral recesses 31, each lateral recess 31 being substantially rectangular in lateral cross-section. As can be seen in FIG. 1, an O-ring 33, which is generally circular in lateral cross-section, is retained within the uppermost recess 31 in order to provide an efficient seal between electrical connector 11 and a mating electrical connector, as will be described further in detail below.

The outer surface of annular mating end 23 is provided with a threaded coupling mechanism 35 proximate its free end. As will be described in greater detail below, threaded coupling mechanism 35 enables electrical connector 11 to be retained in electrical and mechanical connection with a mating electrical connector using threaded coupling means, which is a principal object of the present invention.

Threaded coupling mechanism 35 is represented herein as being in the form of an outwardly extending, spiral-shaped threading. However, it should be noted that threaded coupling mechanism 35 could be in the form of alternative well-known devices which are designed to threadingly engage with a corresponding threaded device without departing from the spirit of the present invention.

Annular cable attachment 25 is designed to receive the free end of a coaxial cable (not shown), the coaxial cable being electrically connected to inner conductor 13 so as to establish an electrical path therebetween. With a coaxial cable connected to inner conductor 13 in the manner as described above, cable attachment 25 is preferably crimped or clamped to secure electrical connector 11 mounted on the coaxial cable.

In use, electrical connector 11 is designed to be retained in electrical and mechanical connection with a mating electrical connector through the use of either snap-fastening or threaded coupling means.

Referring now to FIGS. 3-6, there are shown various drawings which illustrate how electrical connector 11 can be retained in connection with a mating electrical connector 111 using snap-fastening coupling means.

Figure 3:
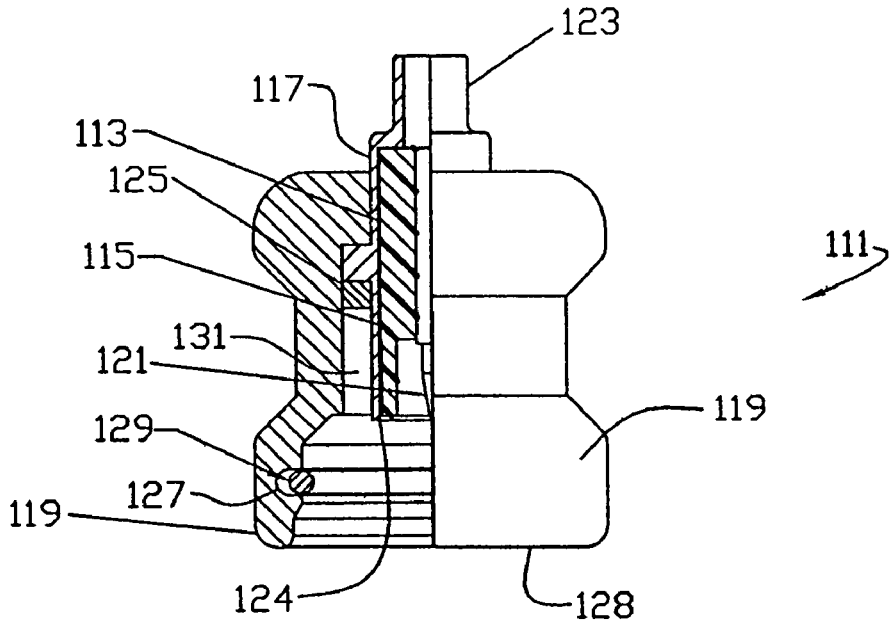
FIG. 3 is a front plan view of the electrical connector shown in FIG. 1, the electrical connector being shown exploded away from a mating electrical connector which can be retained in electrical and mechanical connection therewith using snap-fastening coupling means, both the electrical connector and the mating electrical connector being shown in partial axial section.
Figure 3:
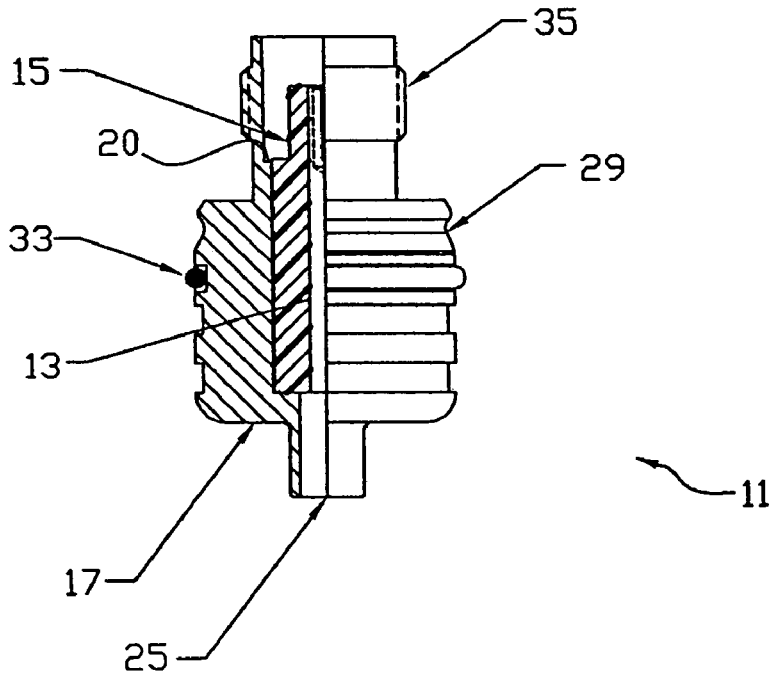

As seen most clearly in FIG. 3, mating connector 111 is represented herein as comprising an inner conductor 113, an annular insulator 115 which surrounds inner conductor 113, a male collar 117 which surrounds insulator 115, and an outer body 119 which surrounds male collar 117.

Inner conductor 113 is represented herein as being in the form of an elongated conductive pin which is responsible for the transmission of communication signals through connector 111. Inner conductor 113 is provided with a male projection, or pin, 121 at one of its ends. It should be noted that male pin 121 is sized and shaped to fittingly penetrate into receptacle 19 of inner conductor 11 and thereby establish an electrical path between connector 11 and connector 111.

Insulator 115 is generally annular in shape and surrounds inner conductor 113. As can be appreciated, insulator 115 serves to both mechanically support inner conductor 113 and electrically insulate inner conductor 113 male collar 117, insulator 115 preferably being constructed of any conventional insulated material, such as PolyTetraFluoroEthylene (PTFE).

Male collar 117 is preferably constructed out of a conductive metal and functions as the outer conductor for connector 111. Male collar 117 (also referred to herein as outer conductor 117) is shaped to immediately surround insulator 115. One end of male collar 117 is shaped to define a cable attachment 123 that is designed to receive the free end of a coaxial cable (not shown), the coaxial cable being electrically connected to inner conductor 113 so as to establish an electrical path therebetween. With a coaxial cable connected to inner conductor 113 in the manner as described above, cable attachment 123 is preferably crimped or clamped to secure electrical connector 111 mounted on the coaxial cable.

It should be noted that collar 117 and insulator 115 at the ID portion of male connector 111 are shaped so as to define an annular sleeve 124 that is spaced adequately between male pin 121 and the inner surface of outer body 119. Preferably, collar 117 is slotted to allow for slight radial flexibility of sleeve 124. Accordingly, as will be shown in detail below, sleeve 124 is adapted to be fittingly disposed against step 20 when connectors 11 and 111 are coupled together.

Outer body 119 is preferably constructed out of a rigid and durable material, such as metal or plastic, and is provided with a generally hourglass shape in lateral cross-section to better grasp connector 111. An annular rubber gasket 125 is disposed in frictional engagement between male collar 117 and outer body 119, the function of gasket 125 to become apparent below.

A rounded, annular groove 127 is formed in the inner surface of outer body 119 near the mating end 128 for connector 111. Furthermore, a C-shaped snap ring 129 (shown in isolation in FIGS. 4(*a*) and (*b*)) is retained within groove 127. Ring 129 is generally circular in lateral cross-section and is preferably constructed out of a material with resilient properties, such as a spring stainless steel or a hard bronze wire. Accordingly, through the application of a suitable expansion force, the free ends of ring 129 can be spaced apart from one another so as to increase the outer diameter of ring 129. However, upon the removal of said expansion force, the resilient nature of ring 129 causes it to return to its original configuration (i.e., to its original outer diameter). As will be described in detail below, snap ring 129 operates in conjunction with engagement groove 30-1 to provide snap-fastening coupling means between connector 11 and connector 111.

Electrical connector 11 can be coupled to mating electrical connector 111 in the following manner. Specifically, as seen most clearly in FIG. 3, mating end 128 of electrical connector 111 is disposed in axial alignment with mating end 23 of electrical connector 11. Disposed as such, connectors 11 and 111 are linearly drawn towards one another until (i) male pin 121 fittingly protrudes into female socket 19, as shown in FIG. 5, thereby establishing an electrical path between connectors 11 and 111 and (ii) sleeve 124 abuts against step 20, thereby limiting further displacement.

It should be noted that, as connectors 11 and 111 are drawn linearly towards one another, ring 129 in connector 111 rides along the outer surface of central body 21 of connector 11. Accordingly, it is to be understood that, as ring 129 slides over ridge 30-3, ring 129 is substantially expanded (i.e., the outer diameter for ring 129 is increased) to allow for further downward displacement of connector 111 relative to connector 11. However, once connector 111 has been slid down over connector 11 to the extent that ring 129 is aligned within engagement groove 30-1, the energy stored within the expanded ring 129 causes it to collapse radially inward back to its original configuration, thereby causing ring 129 to snap into engagement within groove 30-1, as seen most clearly in FIGS. 5 and 6. Furthermore, it should be noted that sloped surface 30-2 of coupling mechanism 29 makes angular contact with ring 129 (as depicted by arrow F in FIG. 6) which, in turn, produces an axial force that urges connectors 11 and 111 together. In particular, it should be noted that the angular contact described in detail above serves to continuously urge the mating portion of outer conductor 17 inward and into in electrical contact with outer conductor 117, which is highly desirable.

In this capacity, it is to be understood that together ring 127 and engagement groove 30-1 provide connectors 11 and 111 with a simple and inexpensive snap-fastening engagement means, which is a principal object of the present invention. In order to decouple connectors 11 and 111, a separation force is required that is large enough to cause ring 127 to expand outward beyond ridge 30-3.

Figure 5:
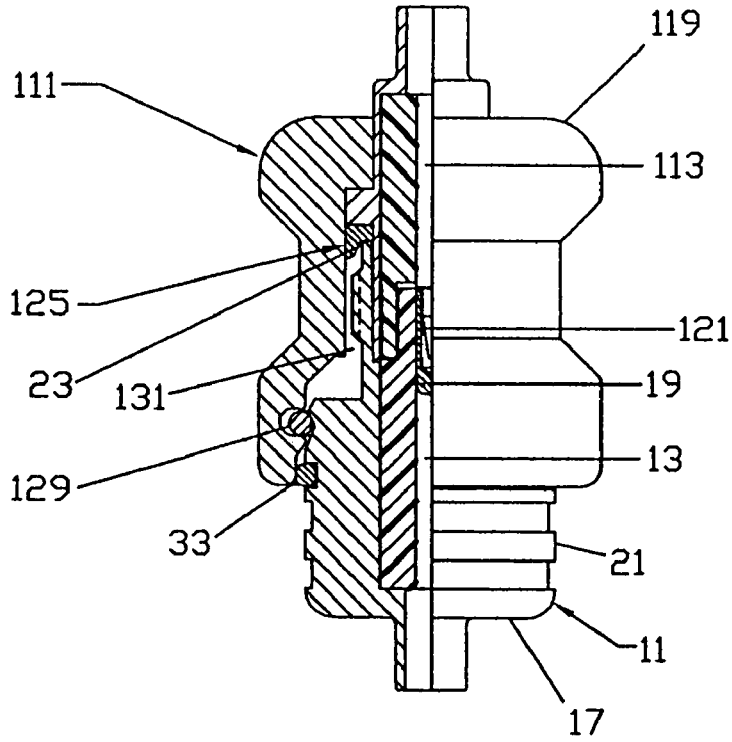
FIG. 5 is a front plan view of the electrical connector and the mating electrical connector shown in FIG. 3, the electrical connector and the mating electrical connector being shown retained in electrical and mechanical connection with one another using snap-fastening coupling means, both the electrical connector and the mating electrical connector being shown in partial axial section.
Figure 6:
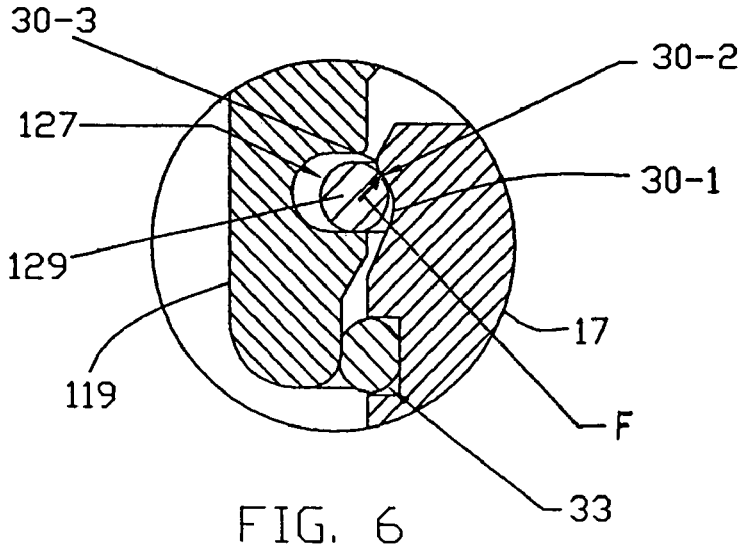
FIG. 6 is an enlarged, front plan, section view of the electrical connector and the mating electrical connector shown in FIG. 5.

It should also be noted that, with connectors 11 and 111 coupled together as described above, mating end 23 of outer conductor 17 abuts against (and partially deforms) gasket 125 in connector 111, as shown in FIG. 5. In addition, with connectors 11 and 111 coupled together as. described above, O-ring 33 creates an effective seal between outer conductor 17 and outer body 119, as shown most clearly in FIGS. 5 and 6. Accordingly, it is to be understood that O-ring 33 and gasket 125 together provide means for preventing water from entering into the inner conductor/insulator region of the coupled pair of electrical connectors.

Furthermore, it should be noted that a significant annular gap 131 is provided between male collar 117 and outer body 119, as seen most clearly in FIG. 5. Gap 131 is sized and shaped to receive the mating end 23 of electrical connector 11 with enough clearance that threading 35 on connector 11 (which is not used in this situation) does not frictionally contact the inner surface of outer body 119, as seen most clearly in FIG. 5.

Figure 7:
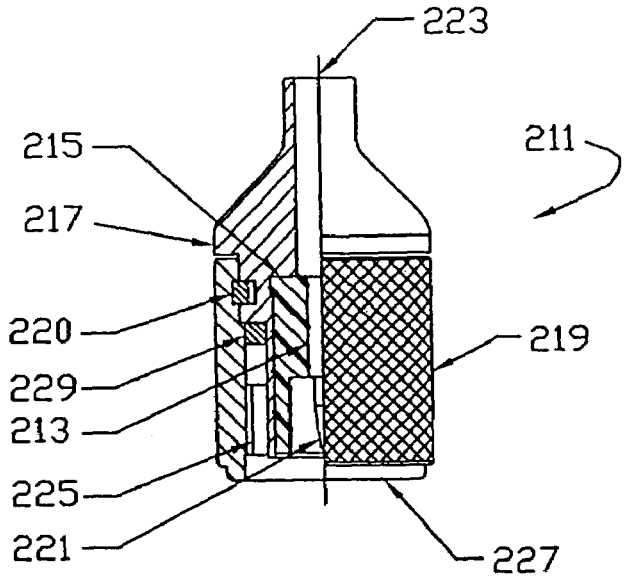
FIG. 7 is a front plan view of the electrical connector shown in FIG. 1, the electrical connector being shown exploded away from a mating electrical connector which can be retained in electrical and mechanical connection therewith using threaded coupling means, both the electrical connector and the mating electrical connector being shown in partial axial section.
Figure 7:
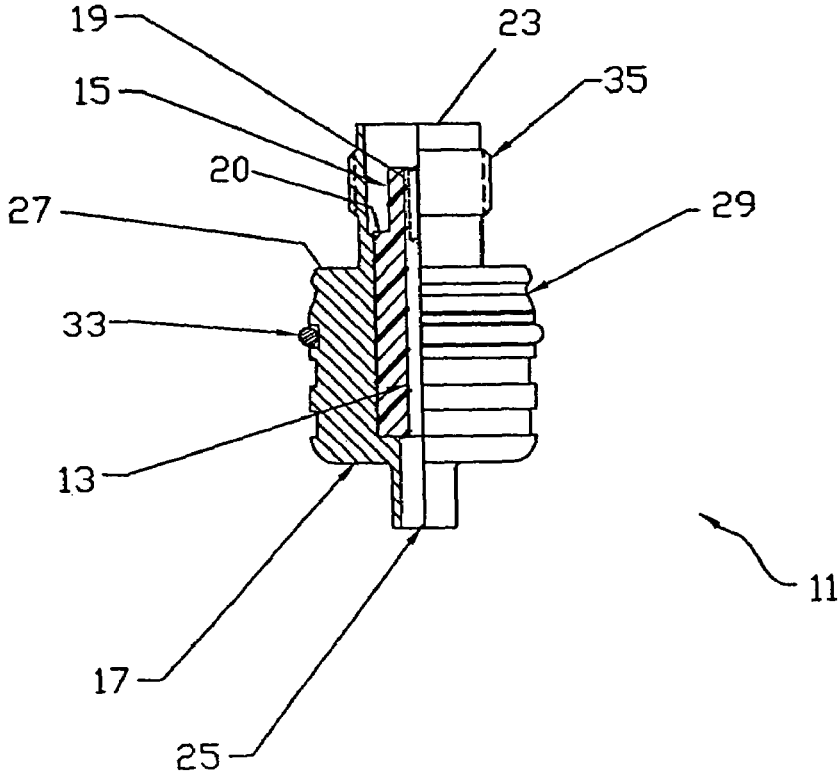
Figure 8:
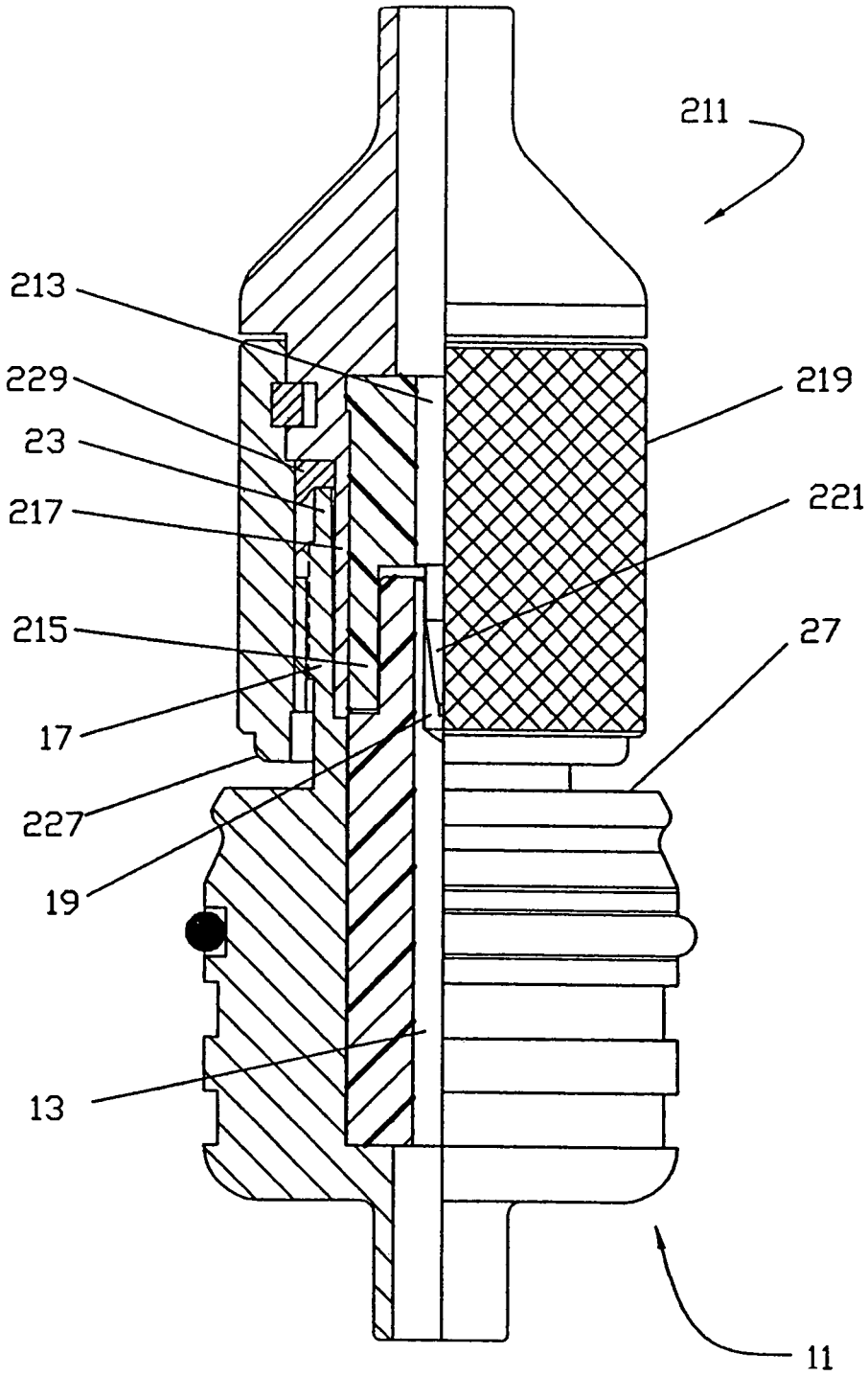
FIG. 8 is a front plan view of the electrical connector and the mating electrical connector shown in FIG. 7, the electrical connector and the mating electrical connector being shown retained in electrical and mechanical connection with one another using threaded coupling means, both the electrical connector and the mating electrical connector being shown in partial axial section.

Referring now to FIGS. 7-8, there are shown various drawings which illustrate how electrical connector 11 can be retained in electrical and mechanical connection with a mating electrical connector 211 using threaded coupling means.

As seen most clearly in FIG. 7, mating connector 211 is represented herein as comprising an inner conductor 213, an annular insulator 215 which surrounds inner conductor 213, an outer conductor 217 which surrounds insulator 215, and a threaded coupling nut 219 which is rotatably coupled to outer conductor 217 by means of a retaining ring 220.

Inner conductor 213 is represented herein as being in the form of an elongated conductive pin which is responsible for the transmission of communication signals through connector 211. Inner conductor 213 is provided with a male projection, or pin, 221 at one of its ends. It should be noted that male pin 221 is sized and shaped to fittingly penetrate into receptacle 19 of inner conductor 11 and thereby establish an electrical path between connector 11 and connector 211. In addition, it should be noted that the mating ends of outer conductor 217 and insulator 215 are sized and shaped to abut against step 20 with the mating end of outer conductor 217 disposed in continuous electrical contact with the inner surface of the mating end of outer conductor 17.

Insulator 215 is generally annular in shape and surrounds inner conductor 213. As can be appreciated, insulator 215 serves to both mechanically support inner conductor 213 and electrically insulate inner conductor 215 from outer conductor 217, insulator 215 preferably being constructed of any conventional insulated material, such as PolyTetraFluoroEthylene (PTFE).

Outer conductor 217 is preferably constructed out of a conductive metal and is shaped to partially surround insulator 215. It should be noted that one end of outer conductor 217 is shaped to define a cable attachment 223 that is designed to receive the free end of a coaxial cable (not shown), the coaxial cable being electrically connected to inner conductor 213 so as to establish an electrical path therebetween. With a coaxial cable connected to inner conductor 213 in the manner as described above, cable attachment 223 is preferably crimped or clamped to secure electrical connector 211 mounted on the coaxial cable.

Threaded coupling nut 219 is preferably constructed out of a rigid and durable material, such as metal, and is generally cylindrical in shape. Threaded coupling nut 219 is rotatably coupled to outer conductor 217 by retaining ring 220. In this capacity, it is to be understood that threaded coupling nut 219 is capable of being freely rotated about its longitudinal axis (in either the clockwise or counterclockwise direction) relative to outer conductor 217.

The inner surface of coupling nut 219 is provided with a threading mechanism 225 proximate the mating end 227 for connector 211. As represented herein, threading mechanism 225 is provided as a threaded groove which is sized and shaped to matingly receive threading 35 on electrical connector 11. Accordingly, because threaded coupling nut 219 can be rotated independently of outer conductor 217, coupling nut 219 enables connector 211 to be secured to connector 11 using screw-type coupling means, as will be described further below.

An annular rubber gasket 229 is disposed in frictional engagement between outer conductor 217 and coupling nut 219, the function of gasket 229 to become apparent below.

Electrical connector 11 can be coupled to mating electrical connector 211 in the following manner. Specifically, as seen most clearly in FIG. 7, mating end 227 of electrical connector 211 is disposed in direct axial alignment with mating end 23 of electrical connector 11. Disposed as such, connectors 11 and 211 are drawn towards one another until (1) the tip of male pin 221 projects into female socket 19 and (2) threading 35 on connector 11 engages with threading 225 on connector 211. At this time, the user rotates coupling nut 219 in the clockwise direction, the outer surface of coupling nut 219 preferably being roughened for gripping purposes. As can be appreciated, due to the engagement between threading 35 and threading 225, the rotation of coupling nut 219 in the clockwise direction draws electrical connector 211 further down onto electrical connector 11. As seen most clearly in FIG. 8, the axial displacement of connector 211 towards connector 11 serves to (1) draw male pin 221 into female socket 19, thereby establishing an electrical path between inner conductors 13 and 213 and (2) draw the mating end of outer conductor 217 into contact with the inner surface outer conductor 17, thereby establishing an electrical path between outer conductors 17 and 217. In order to disconnect connectors 11 and 211, coupling nut 219 is rotated in the counterclockwise direction until such time as it is possible to manually separate connectors 11 and 211.

It should also be noted that, with connectors 11 and 211 coupled together in the manner as described above and as shown in FIG. 8, mating end 227 of connector 211 approaches (and, in fact, may contact) shelf 27 on connector 11. In addition, with connectors 11 and 211 coupled together as such, mating end 23 of outer conductor 17 abuts against (and partially deforms) gasket 229 in connector 211. As a result, it is to be understood that gasket 229 thereby functions as a seal for preventing water from entering into the inner conductor/insulator region of the coupled pair of electrical connectors.

As described in detail above, electrical connector 11 is provided with dual independent means of retaining itself in electrical and mechanical connection with a mating electrical connector (namely, through the use of either snap-fastening or threaded coupling means). Accordingly, the coupling means used to retain electrical connector 11 in connection with a mating electrical connector can be selected based on the particular environment in which electrical connector 11 is to be used. For instance, if electrical connector 11 is to be used, among other things, (1) under a moment of duress, (2) in an environment which is dark, confined and/or rather inaccessible, or (3) as part of a system which requires frequent connection/disconnection (e.g., to repair or replace system components), the use of snap-fastening coupling means would be preferred. However, if electrical connector 11 is to be used, among other things, either (1) in conjunction with a more permanent type of connection or (2) in a rather unstable environment which requires a strong coupling force (e.g., in a high vibration environment and/or to support a large cable weight), the threaded coupling means would be preferred. The ability to select the particular coupling means to be used in conjunction with electrical connector 11 (i.e., by selecting the particular mating connector to be used therewith) serves as a principal novel feature of the present invention.

It is to be understood that numerous modifications could be made to electrical connector 11 without departing from the spirit of the present invention.

For example, it is to be understood that electrical connector 11 could be modified for use in conjunction with alternative applications without departing from the spirit of the present invention. Specifically, referring now to FIG. 9, there is shown another embodiment of an electrical connector constructed according to the teachings of the present invention, the electrical connector being identified generally by reference numeral 311. As will be described further below, electrical connector 311 is a panel mount version of electrical connector 11.

Electrical connector 311 is similar to electrical connector 11 in that electrical connector 311 includes an inner conductor 313, an annular insulator 315 which surrounds inner conductor 13, and an outer conductor 317 which surrounds annular insulator 35.

Inner conductor 313 is similar to inner conductor 13 in that inner conductor 313 is provided with a female socket, or receptacle, 319 at one of its ends, socket 319 serving as a means for electrically coupling connector 311 with a mating electrical connector.

Insulator 315 is similar to insulator 15 in that insulator 315 is generally annular in shape and immediately surrounds inner conductor 313. As can be appreciated, insulator 315 serves to both mechanically support inner conductor 313 and electrically insulate inner conductor 315 from outer conductor 317, insulator 315 preferably being constructed of any conventional insulated material, such as PolyTetraFluoroEthylene (PTFE).

Outer conductor 317 functions similarly to outer conductor 17 in that outer conductor 317 acts as (i) the return path, or ground, for the communication signal transmitted by inner conductor 313 and (ii) a shield for preventing degradation of the communication signal transmitted by inner conductor 313.

Figure 9:
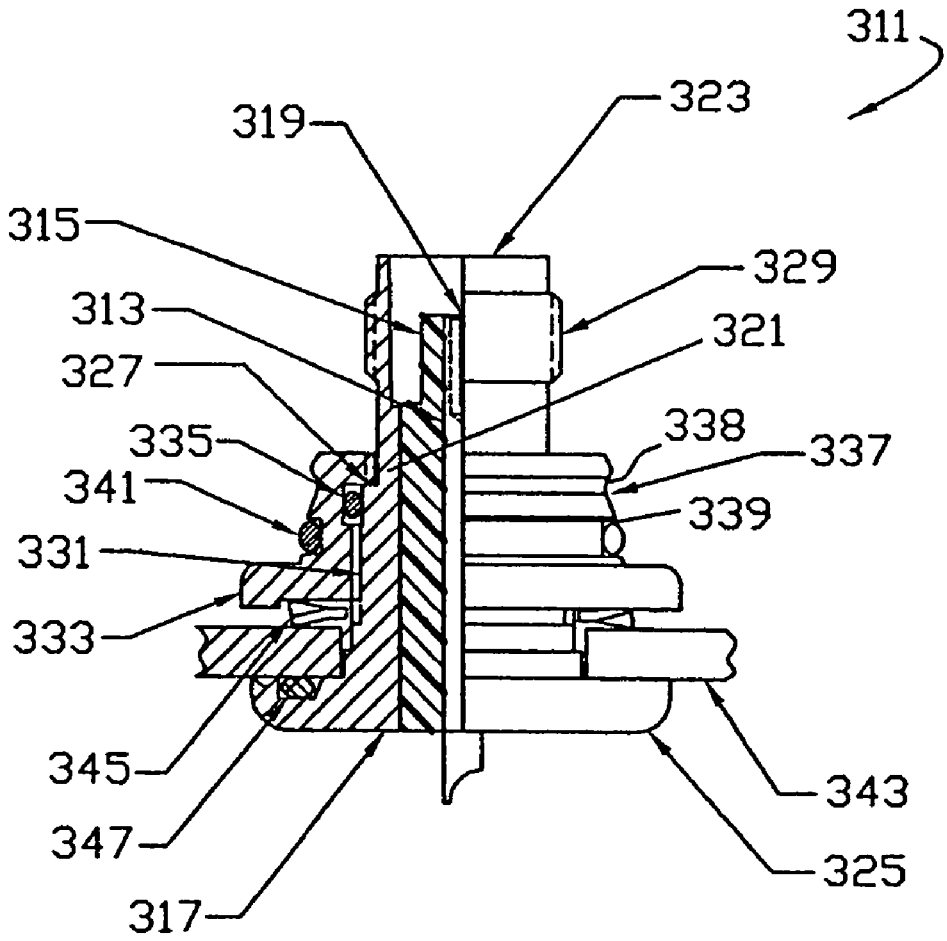
FIG. 9 is a front plan view in partial axial section of a second embodiment of an electrical connector constructed according to the teachings of the present invention.

As can be seen in FIG. 9, outer conductor 317 is an elongated hollow member which includes an annular central body 321, an annular mating end 323 formed at one end of central body 321 and an enlarged flange 325 formed at the other end of central body 321. It should be noted that the outer diameter of central body 321 sharply increases at its approximately midpoint so as to create a flat stop 327, the function of which will be described further below.

The outer surface of annular mating end 323 is provided with a threaded coupling mechanism 329 proximate its free end. Threaded coupling mechanism 329 is represented herein as being in the form of an outwardly protruding spiral threading which is designed to engage with complementary threading on a mating electrical connector (e.g., connector 211). The outer surface of annular central body 321 is also provided with an outwardly protruding spiral threading 331, the function of which will become apparent below.

An internally threaded mounting nut 333 is mounted on central body 321 of outer conductor 317, the internal threading for mounting nut 333 engaging with threading 329 on outer conductor 317. As such, mounting nut 333 is capable of being driven down along the length of central body 321 in a screw-type fashion, with mounting nut 333 eventually abutting against stop 327 to preclude further downward advancement. A first rubber O-ring 335 is preferably provided between mounting nut 333 and central body 321 to create a water-tight seal therebetween.

It should be noted that the outer surface of mounting nut 333 is provided with a snap-fastening coupling mechanism 337 proximate its top end. Coupling mechanism 337 is similar to coupling mechanism 29 in that coupling mechanism 337 is represented herein as being in the form of an annular, laterally extending engagement groove 338 which enables connector 311 to be coupled with a mating electrical connector (e.g., connector 111) using snap-fastening coupling means, which is a principal object of the present invention.

The outer surface of mounting nut 333 is additionally provided with a lateral recess 339 which is substantially rectangular in lateral cross-section. A second O-ring 341, which is generally circular in lateral cross-section, is retained within recess 339 in order to provide an efficient seal between electrical connector 311 and a mating electrical connector (e.g., connector 111).

As noted above, electrical connector 311 is designed to be mounted on a panel 343. Specifically, with flange 325 disposed in abutment against the underside of panel 343, mounting nut 333 is screwed down towards the topside of panel 343. Preferably a lockwasher 345 is disposed between mounting nut 333 and panel 343 to secure electrical connector 311 fixed in place on panel 343. A third O-ring 347 is preferably disposed between flange 325 and the underside of panel 343 to create a tight seal therebetween.

In use, electrical connector 311 is similar to electrical connector 11 in that electrical connector 311 can be secured to a mated electrical connector using either snap-fastening or threaded coupling means, which is the principal object of the present invention.

It should also to be noted that the complementary engagement components for each mated pair of electrical connectors described above could be switched (i.e., reversed) without departing from the spirit of the present invention. For example, instead of providing an engagement groove 30 in connector 11 and a snap ring 129 in connector 111, engagement groove 30 could be provided in connector 111 and snap ring 129 could be provided in connector 11 without departing from the spirit of the present invention.

It should additionally be noted that the present invention is not limited to the particular type of snap-fastening coupling means as described above. Rather, it is to be understood that the snap-fastening coupling means described above could be replaced with alternative types of snap-fastening coupling means (e.g., a ball-socket, finger-groove and/or ring-groove interrelationship) without departing from the spirit of the present invention.

Figure 10:
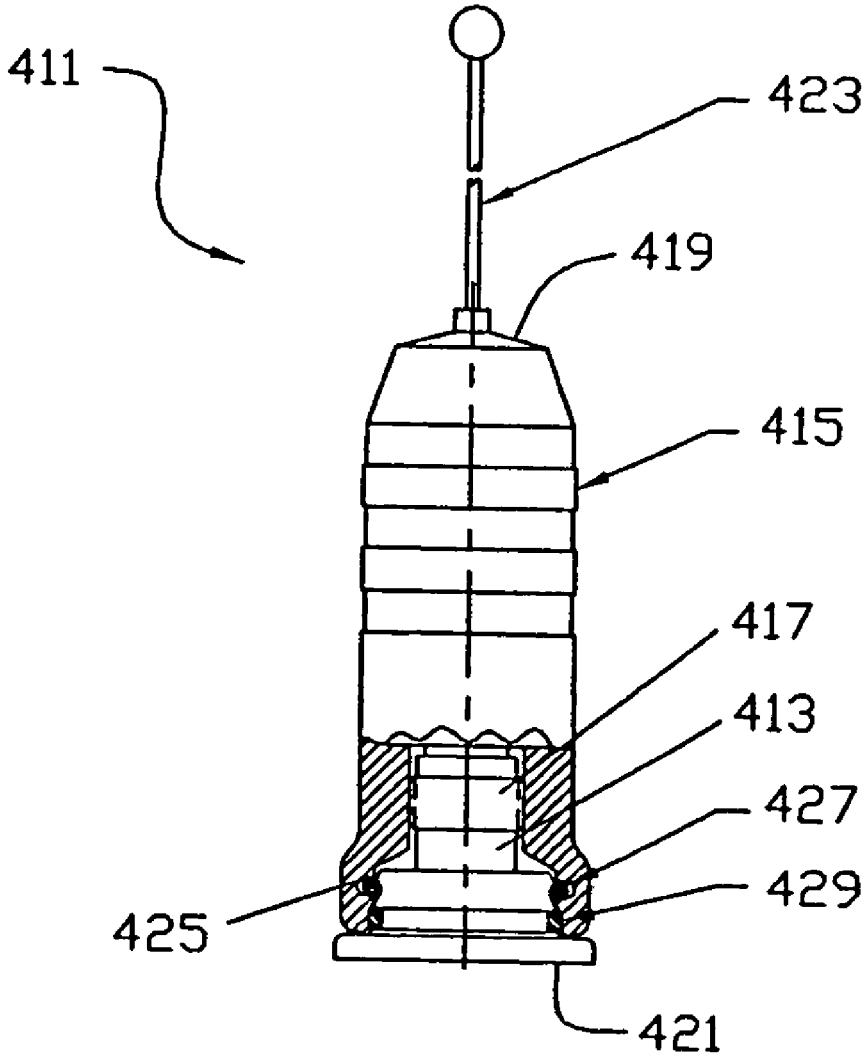
FIG. 10 is a front plan view of another embodiment of a mating electrical connector that has been constructed according to the teachings of the present invention, the mating electrical connector being designed to be retained in electrical and mechanical connection with the electrical connector shown in FIG. 1 using snap-fastening coupling means, the mating electrical connector being shown in partial axial section.

It should further be noted that mating electrical connectors 111 and 211 need not be limited to any particular implementation. Rather, it is to be understood that the mating ends of electrical connectors 111 and 211 could be integrated into other types of electrical devices (e.g., circuit boards, antennae, etc.) without departing from the spirit of the present invention. For example, referring now to FIG. 10, there is shown a mating electrical connector that operates as an antenna, the mating electrical connector being represented generally by reference numeral 411. As will be described further below, mating electrical connector 411 is designed specifically for electrical and mechanical connection to electrical connector 11 using snap-fastening coupling means.

As can be seen, mating connector 411 is represented herein as comprising an inner conductor (not shown), an annular insulator (not shown) which surrounds the inner conductor, a male collar 413 which surrounds the insulator, and a hollowed antenna base 415 which surrounds male collar 413. A support ring 417 is disposed between collar 413 and base 415 to hold collar 413 in place.

It should be noted that antenna base 415 is preferably constructed out of plastic. Base 415 is generally annular in lateral cross-section and includes an enclosed end 419 and a widened mating end 421. An aerial 423 extends through enclosed end 419 and is electrically coupled to the inner conductor in order to establish a conductive path therebetween.

It is to be understood that mating end 421 of antenna 411 is designed to allow for its connection to connector 11 using snap-fastening coupling means. Specifically, mating end 421 is similar to mating end 128 of connector 111 in that the inner surface of base 415 is provided with a rounded, annular groove 425 in which a C-shaped snap ring 427 is disposed, snap ring 427 being identical in construction with snap ring 129, which is shown in isolation in FIGS. 4(*a*) and (*b*).

As a result, connector 411 can be push-mounted onto connector 11 in a similar manner in which connector 111 can be push-mounted onto connector 11. Specifically, connector 411 can be push-mounted onto connector 11 such that snap-ring 427 snaps into engagement within groove 30 to lock together said components. Preferably, an O-ring 429 is mounted on the inner surface of base 415 beneath snap ring 427 to create a water-tight seal between the mated pair of components.

It should be noted that mating end 421 of connector 411 is preferably widened so as to provide ample clearance for threadings 35 on electrical connector 11 when connector 11 is coupled with connector 411.

The versions of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A first electrical connector adapted to be electrically and mechanically connected to a second electrical connector, the second electrical connector comprising a threaded coupling mechanism and a snap-fastening coupling mechanism, said first electrical connector comprising:

(a) an inner conductor;

(b) an insulator surrounding the inner conductor;

(c) a conductive collar surrounding the insulator;

(d) an outer body surrounding the conductive collar; the outer body having an inner surface and an outer surface, the inner surface of the outer body being shaped to define a groove; and (e) a snap-fastening coupling mechanism retained within the groove in the outer body, the snap-fastening coupling mechanism being adapted to engage the snap-fastening coupling mechanism for the second electrical connector to retain the first and second electrical connectors in electrical and mechanical connection with one another;

(f) wherein the conductive collar and the outer body together define an annular gap which is sized and shaped to receive the threaded coupling mechanism for the second electrical connector when the first and second electrical connectors are electrically and mechanically connected together.

2. The first electrical connector as claimed in claim 1 wherein the snap-fastening coupling mechanism is in the form of a snap ring.

3. The first electrical connector as claimed in claim 2 wherein the snap ring is a C-shaped ring constructed out of a material with resilient properties.

4. The first electrical connector as claimed in claim 1 further comprising an aerial coupled to the inner conductor which enables the first electrical connector to operate as an antenna.

* * * * *